United States Patent [19]

Yerian

[11] 4,410,300

[45] Oct. 18, 1983

[54] OIL WELL RABBIT

[76] Inventor: Harold W. Yerian, c/o Pearne, Gordon, Sessions, McCoy & Granger, 1200 Leader Bldg., Cleveland, Ohio 44114

[21] Appl. No.: 231,920

[22] Filed: Feb. 5, 1981

[51] Int. Cl.[3] ..... F04B 47/12

[52] U.S. Cl. ..... 417/56; 92/31; 92/175; 166/153

[58] Field of Search ..... 417/56–59, 417/555 A, 358; 166/153, 154, 156, 193, 194; 92/31, 175; 29/156.5 R

[56] References Cited

U.S. PATENT DOCUMENTS

| | | | |
|---|---|---|---|
| 1,922,396 | 8/1933 | Ricker | 417/56 |
| 2,417,349 | 3/1947 | Colbaugh | 417/555 A |
| 3,179,022 | 4/1965 | Bloudoff | 417/555 A |
| 4,007,784 | 2/1977 | Watson et al. | 417/56 X |
| 4,030,858 | 6/1977 | Coles | 417/56 |

*Primary Examiner*—Edward K. Look

*Attorney, Agent, or Firm*—Pearne, Gordon, Sessions, McCoy, Granger & Tilberry

[57] ABSTRACT

A free piston rabbit for an oil and gas well having gas seal and rotation features which improve its operation, reliability and durability. Circumferential grooves on the body of the rabbit have a turbulence-inducing configuration which improves their gas-sealing capacity while helically oriented slots develop rotation of the body of the rabbit to reduce the risk that the rabbit will become lodged in the production pipe and to improve its sealing capacity by hydrodynamic fluid action.

3 Claims, 2 Drawing Figures

OIL WELL RABBIT

BACKGROUND OF THE INVENTION

The invention relates to oil and gas well production apparatus, and in particular, pertains to an improved free piston for such wells.

PRIOR ART

In oil and gas wells, it is known to employ a so-called "rabbit" or free piston to lift liquids from wells which do not have sufficient gas pressure and volume activity to continuously express such liquids without mechanical devices and/or external assistance. Removal of liquids accumulated in the bottom of such a rabbit well is undertaken to increase gas production rates at the well, since the presence of such liquids in the well production pipes restricts flow of gas through it.

Conventionally, a rabbit well is operated by intermittently shutting a production valve at the upper end of its production pipe to allow gas pressure in the well to build up. During such time, liquids, including oil and water, accumulate above the rabbit which is at rest near the bottom of the well. These liquids migrate upwards through the clearance between the rabbit and the inner walls of the production pipe. At some point determined by a timer, or manually, the production valve is opened to a receiving tank whereby pressure in the upper region of the production pipe above the rabbit is reduced. The pressure differential above and below the rabbit causes the rabbit to rise in the production pipe and thereby lift liquids present above it. The performance of the rabbit in lifting these accumulated liquids depends on how well it seals against gas tending to escape in the clearance between the rabbit and production pipe wall. To the extent that the rabbit is ineffective to seal against upward escape of the gas between the rabbit and production wall, pressure is equalized across the upper and lower faces of the rabbit and the net force lifting the rabbit is lost. As a consequence, the rabbit may become stalled in the production pipe and not completely perform its intended function of raising the column of oil collected above it.

Rabbit piston designs of varying complexity have been proposed. Examples of the prior art are shown in U.S. Pat. Nos. 1,922,396; 3,181,470; and 4,007,784. Free piston devices which employ relatively moving parts, such as valves, fins, flappers, and the like, have proved in use to be subject to failure. Free piston rabbits are prone to structural failure because of the existence of abrasive, corrosive and the fouling substances existing in the well in addition to high speeds and impacts experienced by the rabbit. A structural failure can be quite troublesome where a part of a piston rabbit becomes jammed in a production pipe and cannot be extricated by fishing procedures.

SUMMARY OF THE INVENTION

The invention provides an improved well rabbit which affords a high gas seal capacity as well as resistance to wear and structural failure. The rabbit comprises a one-piece elongated generally cylindrical body having external circumferential gas-sealing grooves spaced along its length and a set of helically oriented slots at its lower end. The circumferential grooves, which work collectively in the manner of a labyrinth seal, are undercut in a way to deflect escaping gas streams and promote turbulence to thereby effectively improve their gas-sealing capability. The undercut profile and relative spacing of the grooves leaves a large surface area between the grooves for distributing radial forces and thereby decreasing the wear rate of the rabbit. The helically oriented slots convert energy of upwardly escaping gas into rotational energy in the rabbit. The rotation of the rabbit improves its action in two distinct ways. First, rotation and rotational energy in the rabbit reduces the risk that it will become lodged in the production pipe during its ascent due to any braking action which might otherwise be imparted by deposits of parafin, particles of sand or the like on the wall of the pipe. Second, hydrodynamic sealing capacity of layers of oil in the clearance between the rabbit and pipe wall is improved by the relative rotation between the rabbit and pipe wall.

DESCRIPTION OF THE PREFERRED EMBODIMENT

DESCRIPTION OF THE PREFERRED EMBODIMENT

Figure 1:
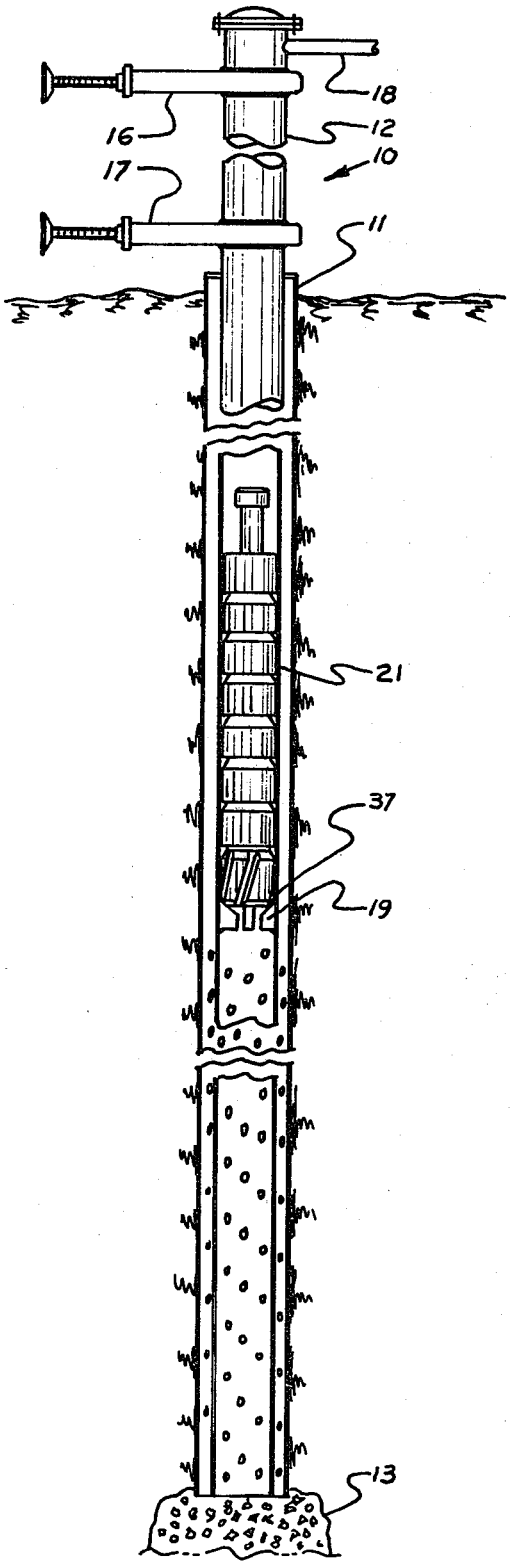
FIG. 1 is a schematic elevational view, partially in cross section, of a well assembly in which the piston rabbit of the invention is employed.

Referring now to the drawing, and in particular FIG. 1, there is shown a well assembly 10 for withdrawing natural gas and oil from below the earth's surface. The depth of the well 10 can exceed 1,000 feet, for example. The well assembly 10 includes an outer casing 11 and an inner line or production pipe 12. In the illustrated case, the bottoms of the casing 11 and production pipe 12 rest on a concrete pad 13. The lower portions of the casing 11 and production pipe 12 are perforated for eduction of natural gas and oil from the surrounding soil. Above the earth's surface, the production pipe 12 is provided with a pair of valves 16, 17, the upper being designated a delivery or production valve 16 and the lower being designated a pressure valve 17. Above the delivery valve 16, a lateral line 18 is adapted to convey the production of the line 12 to a storage tank or other receiving medium. Above the perforated lower section of the production pipe 12, for example, about 40 feet off the bed 13, the production pipe is provided with an internal seat nipple 19.

A free piston rabbit 21 constructed in accordance with the invention is adapted to slide up and down in the bore of the production pipe 12 in a manner described hereinafter. The rabbit 21 is an elongated generally circular solid body having the major portion of its side surface areas generally described by an imaginary common cylinder. The rabbit 21 is machined or otherwise fabricated of steel or other suitably serviceable material. An upper end of the rabbit 21 has a knob 22 at the free end of an extension 23 of reduced diameter. The knob 22 provides a grip for fishing instrumentalities in event that the rabbit 21 becomes lodged in the production pipe 12.

Figure 2:
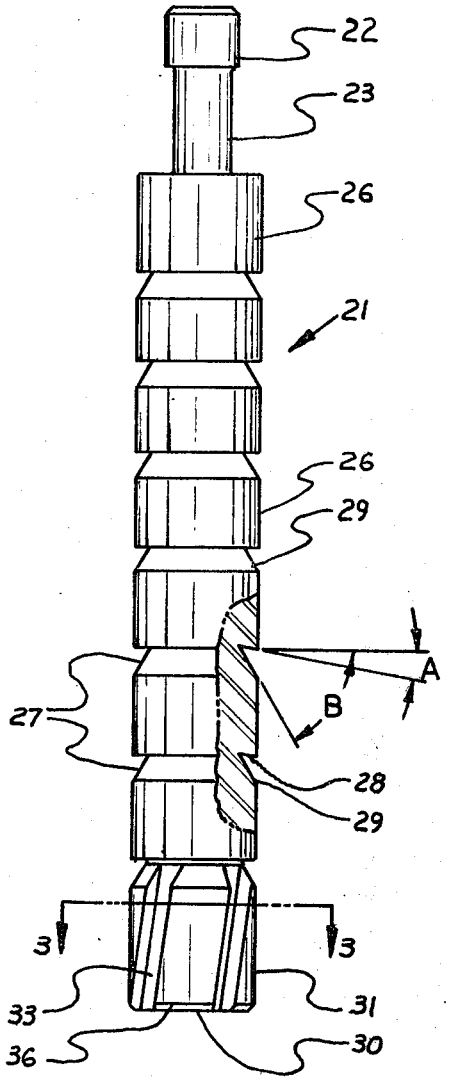
FIG. 2 is a side view, partially in section, of the piston rabbit.
Figure 3:
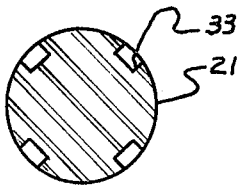
FIG. 3 is a cross-sectional view of the lower end of the piston rabbit taken in a plane indicated by the line 3—3 in FIG. 2.

The main length of the rabbit body is characterized by a series of cylindrical lands 26 of equal diameter interrupted by a series of circumferential grooves 27. As shown, the lands 26 and grooves 27 are equally spaced axially along the body of the rabbit 21. Inspection of FIG. 2 reveals that the circumferential grooves 27 all have substantially the same undercut structure or profile with their forward or upper surfaces 28 being conical and formed by a relatively shallow angle A of, for instance, 10° from a radial plane. Similarly, the grooves 27 have a rearward or lower surface 29 being conical and forming a relatively large angle B of, for example, 60° with a radial plane.

The lower end of the rabbit 21 includes a generally radial end face 30 and a cylindrical surface 31 having an axial length somewhat greater than an individual land 26, but a diameter substantially equal to that of the lands. Formed in the lower end 31 of the rabbit are a set of open faced grooves or slots 33. The slots 33 in the illustrated case being four in number are equally spaced about the circumference of the rabbit end 31 and are oriented at a relatively shallow angle of, for example, 15° from a longitudinal direction so that they are helical in form. As shown, the slots 33 communicate from the lower end face 30 upwardly into the lowermost of the circumferential grooves 27. The end face 30 is beveled at 36 to rest on the conical surfaces, designated 37, of the seat nipple 19.

In operation of the well 10, natural gas and oil pass into the lower end of the casing 11 and production pipe 12. In a rabbit well, the rate of oil flow is relatively limited and as it accumulates in the production pipe 12, it restricts the flow of gas through the well. The level of oil eventually rises above the rabbit 21 by slowing passing through the clearance between the rabbit and inside wall of the production pipe 12. From prior experience with a particular well, it can be estimated when a significant amount of oil has accumulated above the rabbit 21. At this point, determined by a timer, for example, the delivery valve 16, previously closed at the end of a prior cycle, is opened to connect the production pipe with a storage or processing tank or other receiving medium and to reduce the pressure in a production pipe above the rabbit 21. With this reduced pressure, the differential pressure on the rabbit 21 produces a net upward force on it to drive it off the seat up to the delivery valve 16. Under proper conditions, the rabbit 21 lifts the oil in the well which has accumulated above it and drives it through the lateral pipe 18 associated with the delivery valve 16. The delivery or production valve 16 is then closed and the rabbit 21 drops down to the seat 19 to initiate a subsequent cycle.

The improved structure of the disclosed rabbit 21 is highly efficient in sealing against gas flow through the clearance between it and the interior wall of the production pipe 12 during its ascent from the seat 19. The undercut slots or grooves 27 primarily function collectively as a labyrinth-type seal, each groove 27 and land 26 tending to divide up the total pressure differential across the upper and lower faces of the rabbit 21. Additionally, the rearwardly facing shallow conical surfaces 28 are believed to deflect gas streams hugging the exterior of the rabbit 21 inwardly which streams then set up pockets of turbulence that extend into the clearance space between the rabbit and pipe bore. This turbulence is able to reduce the effect of clearance and thereby reduce gas leakage axially along the rabbit 21.

The energy of gas leakage across the rabbit 21 is also harnessed by the helically inclined grooves 33 through which at least a portion of such leakage passes tending to spin the rabbit 21 by producing tangential reaction forces on the rabbit as it flows upwardly through the grooves. The spin imparted to the full body of a rabbit 21 is advantageous in its operation. The rabbit spin is adapted to produce a hydrodynamic liquid seal between the cylindrical surfaces 26 and wall of the pipe 12 with any liquids between the rabbit and pipe wall. The establishment of hydrodynamic seal operation between the rabbit and the interior pipe wall can enhance the simple labyrinth seal effect of the grooves 27. Additionally, the spin of the entire body of the rabbit 21 represents angular momentum which is available to help avoid the risk of the rabbit 21 becoming lodged midway in the length of the production pipe where clearances between it and the adjacent wall may be restricted by deposits of paraffin, sand and the like. The communication of the helically oriented grooves 33 with the lowermost of the circumferential grooves 27 allows this lowermost groove to act as a manifold for the individual helical grooves 33 so that gas passing through any individual of such helical grooves is distributed circumferentially around the rabbit so that it can be most effectively sealed by the labyrinth action of the remaining circumferential grooves 27. The monolithic or one-piece structure of a rabbit 21 minimizes the chance of breakage of any of its component structure, thus greatly improving its reliability.

Although the preferred embodiment of this invention has been shown and described, it should be understood that various modifications and rearrangements of the parts may be resorted to without departing from the scope of the invention as disclosed and claimed herein.

What is claimed is:

1. A well rabbit comprising an elongated circular body, the body including a plurality of circumferential grooves on its exterior, said grooves being axially distributed along a major portion of the length of the body and having a generally uniform axial spacing, said grooves forming a labyrinth-type seal to resist passage of gas upwardly past the rabbit in the clearance in a surrounding production pipe, the body including land areas intervening the grooves, said land areas being relatively greater in axial length than the axial length of said grooves measured at the cylinder defining said lands, said grooves having an undercut profile such that they each include a forward surface which extends both radially inwardly and axially upwardly, said forward groove surfaces having a form of a shallow cone forming a relatively small angle with a plane perpendicular to the axis of the rabbit, said grooves each being defined by a second rearward conical surface forming a relatively large angle with a plane perpendicular to the axis of the rabbit and intercepting its respective shallow cone at a locus axially forward of the edge at the intersection of the respective shallow cone and the adjacent cylindrical land.

2. A well rabbit as set forth in claim 1 including a set of generally helically oriented open-faced grooves on the exterior of said rabbit, said helically oriented grooves being distributed around the body of the rabbit at circumferentially spaced locations, said helically oriented grooves being arranged to conduct a portion of any gas escaping upwardly over the exterior of the rabbit and to convert the energy of such portion of escaping gas into rotation of the full body of the rabbit, said helically oriented grooves having an axial length which is small in comparison to the overall length of the rabbit and being disposed at the lower end of the body of the rabbit, said rabbit including at substantially its lowermost extent a lower radial end face, said helically oriented grooves being constructed and arranged to afford direct communication between said radial end face and a lowermost one of said circumferential grooves.

3. A well rabbit as set forth in claim 1 including a plurality of generally helically oriented open-faced grooves on the exterior of the rabbit, said helical grooves providing communication between the lower face of the rabbit and a lowermost one of said circumferential grooves, said helical grooves being constructed and arranged to convert energy of gas passing therethrough into rotation of said rabbit whereby hydrodynamic bearing operation of the lands through cooperation with the surrounding pipe wall and fluids in the pipe enhances the gas-sealing capacity of such lands and reduces the risk of lodgement of the rabbit along its path through the pipe by virtue of the rotational momentum of the full rabbit body.

* * * * *